US005465961A

United States Patent [19]

Burtch

[11] Patent Number: 5,465,961

[45] Date of Patent: Nov. 14, 1995

[54] PUNCH-OUT GAME

[75] Inventor: Ronald P. Burtch, Stouffville, Canada

[73] Assignee: Ronald P. Burtch & Associates Limited, Canada

[21] Appl. No.: 251,681

[22] Filed: May 31, 1994

Related U.S. Application Data

[63] Continuation-in-part of Ser. No. 241,693, May 12, 1994.

[51] Int. Cl.[6] ..... A63F 7/06; A63H 33/08

[52] U.S. Cl. ..... 273/85 R; 273/58 D; 273/94; 273/336; 273/399; 446/148; 446/488

[58] Field of Search ..... 273/85 R, 94, 273/1.5 A, 55 R, 58 D, 399, 336, 1.5 R; 446/148, 487, 488

[56] References Cited

U.S. PATENT DOCUMENTS

| | | | |
|---|---|---|---|
| 905,085 | 11/1908 | Lexow . | |
| 927,499 | 7/1909 | Davis . | |
| 2,138,361 | 11/1938 | Snelling | 40/310 |
| 2,424,016 | 7/1947 | Botts | 124/16 |
| 3,622,160 | 11/1971 | Barrfield | 273/85 C X |
| 3,724,855 | 4/1973 | Chu | 273/399 |
| 4,010,953 | 3/1997 | Russo | 273/85 C |
| 4,257,605 | 10/1979 | Bancroft | 273/128 A |
| 4,335,165 | 3/1981 | Powers | 273/160 X |
| 5,104,124 | 4/1992 | Bernard et al. | 273/85 F |
| 5,110,127 | 5/1992 | Potter | 273/85 R |

*Primary Examiner*—William H. Grieb
*Attorney, Agent, or Firm*—Larson and Taylor

[57] ABSTRACT

A novelty punch-out game card comprises punch-out elements for, when assembled, simulating elements of a sporting game such as basketball, football or the like. The punch-out card comprises a card member including a plurality of elements adapted to be punched out therefrom and then assembled to form the components used in the game. The elements include a mountable element which is adapted to be affixed to a suitable item, a target element integral with or affixable to the mountable element so as to form a target, and at least one projectile element, for, in use after being punched out of the card member, forming a projectile adapted to be propelled at the target. Further elements, which are adapted to be punched out from the card member, form a propelling device for propelling the projectile at the target.

21 Claims, 5 Drawing Sheets

PUNCH-OUT GAME

RELATED APPLICATION

This is a continuation-in-part of application Ser. No. 08/241,693, filed May 12, 1994.

FIELD OF THE INVENTION

The present invention relates to novelty games particularly adapted to be sold or given away in connection with promotions of various products and, more specifically, to an inexpensive novelty game card which includes punch-out components that, when assembled, simulate an existing game such as basketball, football or the like.

BACKGROUND OF THE INVENTION

As noted above, the present invention is concerned with, but is not limited to, novelty games and devices which are useful as give-away items in connection with sales of a particular product or with product promotions in general. An obvious constraint on the commercial viability of such devices is that the devices must be very inexpensive to manufacture. On the other hand, in order for the game or game device to create interest in the associated product, the device must be amusing or, diverting or otherwise appealing to the user.

As mentioned above and as is explained in more detail below, the present invention is concerned with providing a game device which, when the components thereof are assembled, simulates a popular game such as basketball or football. Patents relating to game devices and other devices of general interest here include the following: U.S. Pat. Nos. 2,424,016 (Botts); 5,104,124 (Bernard et al.); 4,010,953 (Russo); 905,085 (Lexow); 3,622,160 (Barfield); 3,724,855 (Chu); 4,335,165 (Powers); 927,499 (Davis); 4,257,605 (Bancroft); 5,110,127 (Potter).

Briefly considering these patents, the Botts patent discloses a basketball game including a basket, a control lever, and a ball. The components of the game can be constructed of flat strips of a material such as cardboard. The Bernard et al. patent discloses a collapsible basketball game made of a flat material such as paperboard, and including a basket, a disk-shaped basketball, and a spring-like lever. The game can be provided as a novelty item, and, in this regard, can, for example, be affixed to the back of a cereal box. The Russo, Lexow, Barfield, and Chu patents all disclose basketball games including a basket, a game ball, and a lever to project the ball towards the basket. The Potter patent discloses a football game with goal posts and a football which may be flicked towards the goalpost with a finger. The Bancroft patent discloses two identical notched members which are connected together to form a ball. The Powers and Davis patents both disclose "spherical" ornaments constructed of planar members.

SUMMARY OF THE INVENTION

In accordance with the invention, a novelty punch-out game card is provided which is inexpensive to manufacture, which is easy to assemble into its component parts and which, when assembled, simulates, in an appealing and interesting way, a popular sport or game, and uses a relatively ubiquitous item readily found at an eating or drinking establishment as part of the game assembly. Suitable ubiquitous items for use as part of the game assembly include: a beverage bottle or other such beverage container; a catsup bottle or other food/condiment container; a drink cup or glass, food bowl, or other item having an upstanding or other projecting rim portion such as menu and napkin holders, display devices, trays, fixtures (such as lamps or shades thereof), and the like; or any other like items commonly found at eating or drinking establishments. The resulting game is entertaining to play and would, for example, have particular appeal to customers at a "sport's bar" or like establishment.

According to a preferred embodiment thereof, the novelty punch-out game card of the invention comprises punch-out elements for, when assembled, simulating elements of a sporting game, the punch-out card comprising a card member including a mountable element adapted to be punched out of the card member and including affixing means for affixing the mountable element to a ubiquitous item, a further target element adapted to be punched out of the card member and to be affixed to the mountable element to form a target; and at least one projectile element, adapted to be punched out of the card member, for, in use when so punched out, forming a projectile adapted to be propelled at the target.

Preferably, the card member further comprises at least one further element adapted to be punched out from said card member and forming, in use, propelling means for propelling said projectile at said target. Advantageously, the propelling means comprises at least two further elements adapted to be punched out from the card member.

In one preferred implementation, the two further elements include cooperating connecting means for affixing the two further elements together in orthogonal relation to one another to form a pivotable launching assembly for the projectile.

In one embodiment of this implementation, there are two of these further elements, and one of said two further elements is shorter than the other and forms a pivot axis around which the other element can be pivoted.

In a further embodiment of this implementation there are three of said further elements, two of said three further elements comprising identical pieces which are separated along a common separation line and which each include a curved edge opposite the common separation line These pieces, when punched out and separated, are securable together in parallel relation to form a rockable base which rocks on said curved edges. The other of said three further elements comprises a transverse connecting piece including means for securing said two further elements together in said parallel relation.

In an embodiment wherein the game being simulated is basketball, the mountable element preferably comprises a base piece including a portion forming said affixing means and a portion simulating the rim of a basket used in basketball and constituting the target element. Advantageously, the target element further comprises a further piece connectable to said base piece and simulating the backboard of a basket used in basketball. In one preferred embodiment, the affixing means comprises an opening in said base piece adapted to fit around the neck of a beverage bottle or the like. The projectile element advantageously comprises a pair of circular pieces including means for connecting the circular pieces together in orthogonal relation to simulate a basketball.

In an embodiment wherein the game being simulated is football, the mountable element preferably includes a base piece including said affixing means, and said target element includes a substantially U-shaped piece connectable to said base member and simulating a football goal post. Advantageously, the card member further includes an additional element adapted to be punched out of said card for interconnecting the base piece and the U-shaped piece. The affixing means preferably comprises an opening in the base piece adapted to fit around the neck of a beverage bottle or the like. The projectile element advantageously comprises first and second substantially identical ellipsoidal shaped pieces including means for connecting said ellipsoidal pieces together in orthogonal relation to simulate a football.

In an embodiment wherein the game being simulated is horseshoes, the mountable element includes a base piece including said affixing means, and the target member includes a stake piece affixed to the base piece and simulating a stake used in the game of horseshoes. In this embodiment, the at least one said projectile element comprise a pair of substantially U-shaped pieces simulating horseshoes. In an advantageous implementation, the affixing means of the base piece includes a substantially U-shaped portion adapted to fit around the base of a beverage container or the like.

Also disclosed is an affixing means for affixing any of the embodiments to a ubiquitous item having a rim. This affixing means is advantageously simply a slot provided in a suitable mounting element.

Other features and advantages of the invention will be set forth in, or apparent from, the following detailed description of preferred embodiments of the invention.

DESCRIPTION OF THE PREFERRED EMBODIMENTS

Figure 1:
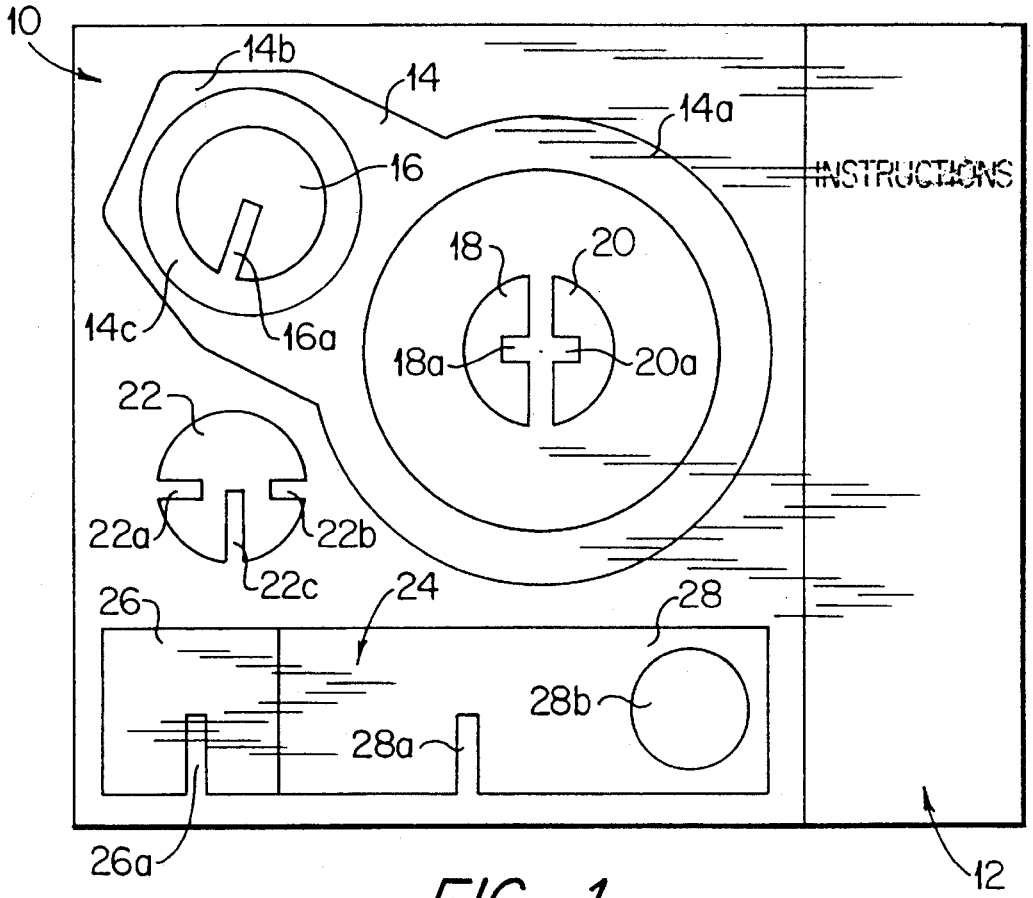
FIG. 1 is a plan view of a novelty punch-out card in accordance with a first embodiment of the invention.

Referring to FIGS. 1 to 4, there is shown a novelty punch-out game card in accordance with a first embodiment of the invention. The card, which is generally denoted 10, includes punch out components which, when assembled, simulate elements of the game of basketball. The card 10 also includes instructions, indicated at 12, which explain and depict the manner in which the components of the game are assembled and the game is played with the assembled components. Card 10 is preferably made out of a laminate of a plastic such as polyethylene with plastic coatings or films on the front and back surfaces thereof which are of a type that is readily printable, although other materials (e.g., cardboard with plastic or other coatings) can also be used.

The punch-out components of the game include a basket element 14 including an annular hoop or rim portion **14*a* and a base or mounting portion 14*b* including a central aperture 14*c* therein. A simulated basketball is formed by slotted punch-out elements comprising a circular element 16, half-circle elements 18, 20, and circular element 22. Three of these elements, viz., element 16 and elements 18 and 20 are disposed for the sake of convenience and space savings, within aperture 14*c* and the opening of hoop 14*a*, respectively. Element 16 includes a slot 16*a*, element 18 includes slot 18*a*, element 20 includes a slot 20*a* and element 22 includes slots 22*a*, 22*b* and 22*c***.

A further punch-out component 24 formed in card 10 is used to provide a launch or propelling device for the "basketball" and includes separable slotted elements 26 and 28, which are readily separable from each other along a performed cut line 30. Element 26 includes a slot or notch **26*a* while element 28 includes a slot 28*a* and a circular opening 28*b***.

Figure 2:
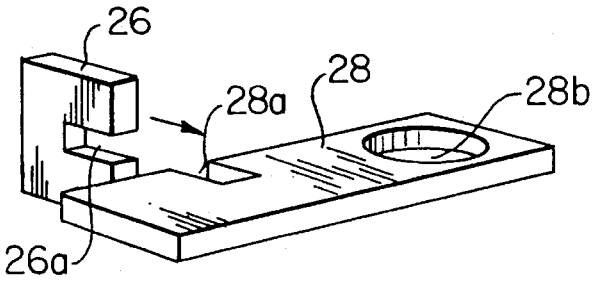
FIG. 2 is a perspective view showing the manner of assembly of one of the components of the game of FIG. 1.

Referring to FIG. 2, there is shown the manner of assembly of the launch formed by components 26 and 28. As illustrated, the slots **26*a* and 28*a* are simply fitted together so that element 26 is joined to and disposed at right angles to element 28 and thus forms a pivot element for the launch, as described below in connection with FIG. 4**.

Figure 3:
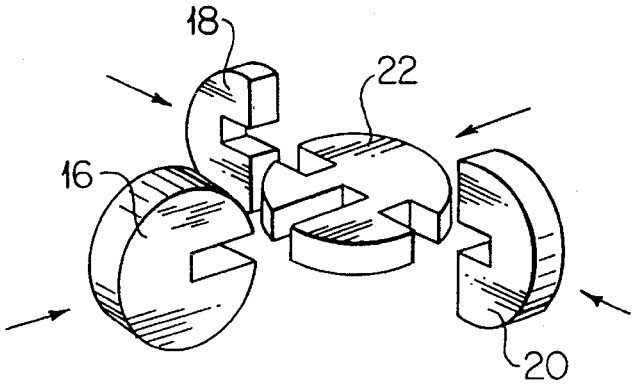
FIG. 3 is a perspective view showing the manner of assembly of a further one of the components of the game of FIG. 1.

Referring to FIG. 3, there is shown the manner in which elements 16, 18, 20 and 22 are assembled to form the "basketball." As illustrated, the slots **16*a*, 18*a* and 20*a* in elements 16, 18 and 20, respectively, are engaged in corresponding slots 22*c*, 22*a* and 22*b* in element 22** so that a round or spherical "basketball" shape is simulated.

Figure 4:
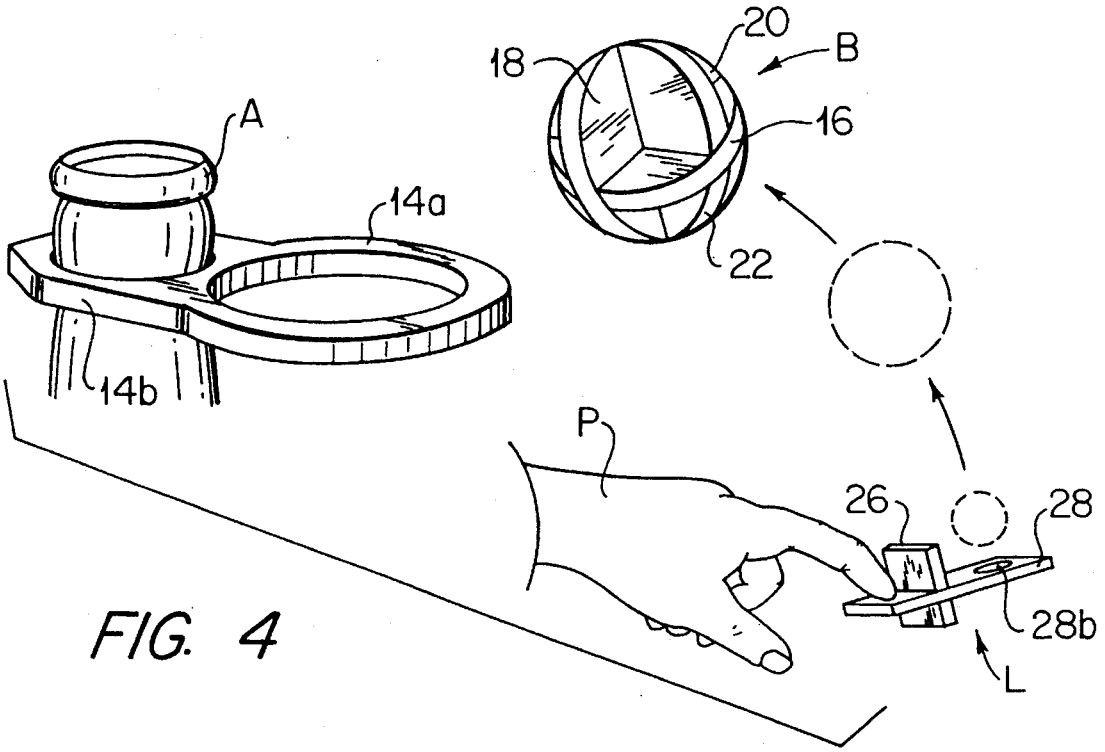
FIG. 4 is a perspective view showing the manner in which the game of FIG. 1 is played.
Figure 5:
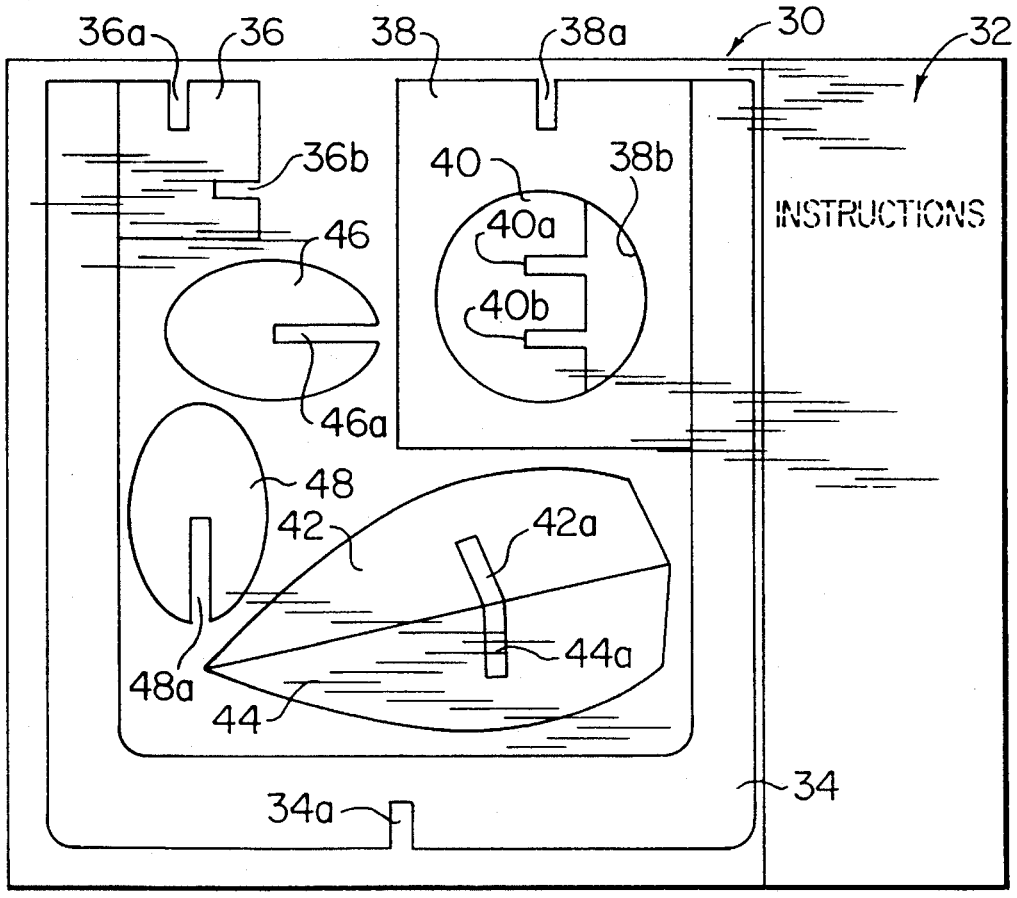
FIG. 5 is a plan view of a novelty punch-out card in accordance with a further embodiment of the invention.

Referring to FIG. 4, there is illustrated the manner in which the simulated basketball game is played. As shown, the basket element 14 is mounted on a beverage bottle A with base or mounting portion **14*b* fitted around the neck of bottle A and hoop 14*a* extending outwardly therefrom. Initially, the "basketball" formed by elements 16, 18, 20 and 22, and denoted B, is disposed in opening 28*b* of element 28 of the launching device, denoted L in FIG. 4, and the device L is pivoted to the position shown in dashed lines. A player P can cause the device L to rapidly pivot to the position shown in solid lines, and thus launch or propel the basketball B towards the hoop 14*a*, by rapidly deflecting the other end of launch L, as indicated. The object of the game is, of course, to launch or propel the ball B in such a manner as to cause the ball B to go through the hoop 14*a***, thereby simulating the making of a basket in basketball.

Referring to FIGS. 5 to 9, there is shown a novelty punch-out game card in accordance with a second embodiment of the invention. This card, generally denoted 30, includes punch-out components which, when assembled, simulate elements of the game of football, and, in particular, the kicking of a field goal in football. The card 30 also includes, printed along one edge and indicated at 32, instructions explaining and depicting the manner in which the components are assembled and the game is played.

The punch-out components of this game include a U-shaped element 34 including a notch 34*a* in the base portion and having detachably secured thereto rectangular mounting elements 36 and 38 along respective cut lines. Element 36 includes notches 36*a* and 36*b* in two edges thereof while element 38 includes a notch 38*a* in one edge and an opening 38*b* near the center thereof. Detachably secured to element 38 within opening 38*b* is a punch-out brace element 40 having a pair of notches 40*a* and 40*b* therein.

A pair of punch-out launcher elements 42 and 44 are detachably connected together along a straight common cut line and includes notches 42*a* and 44*a* in the straight edges produced when elements 42 and 44 are separated. The elements 42 and 44 each also include a long curved edge on which the elements rest in use.

A further pair of punch-out elements 46 and 48 are used to simulate a "football." Elements 46 and 48 are elliptical in shape and include respective notches 46*a* and 48*a* which fit together.

Figure 6:
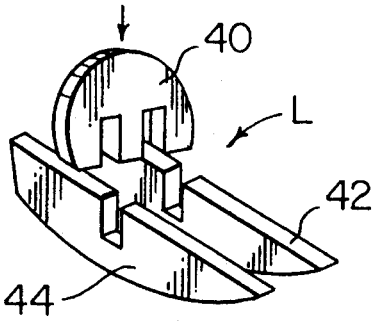
FIG. 6 is a perspective view showing the manner of assembly of one of the components of FIG. 5.

Referring to FIG. 6, there is illustrated the manner in which a launching device or launcher, denoted L is assembled from elements 40, 42 and 44. As shown, elements 42 and 44 are arranged in parallel relation with the curved edges down and the notches 40*a* and 40*b* of brace element 40 are inserted into notches 42 and 44*a* so as to form a pivotable or rockable stand or support constituting the launcher.

Figure 7:
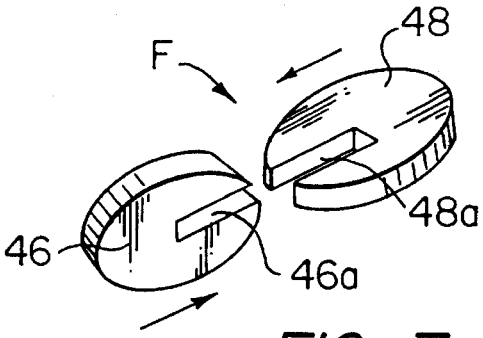
FIG. 7 is a perspective view showing the manner of assembly of a further one of the components of the game of FIG. 5.

Referring to FIG. 7, there is shown the manner in which a "football" F is formed by elements 46 and 48. As shown, the notches 46*a* and 48*b* in elements 46 and 48 are simply fit together so that the elements are disposed at right angles and thus the spheroidal shape of a football is simulated.

Figure 8:
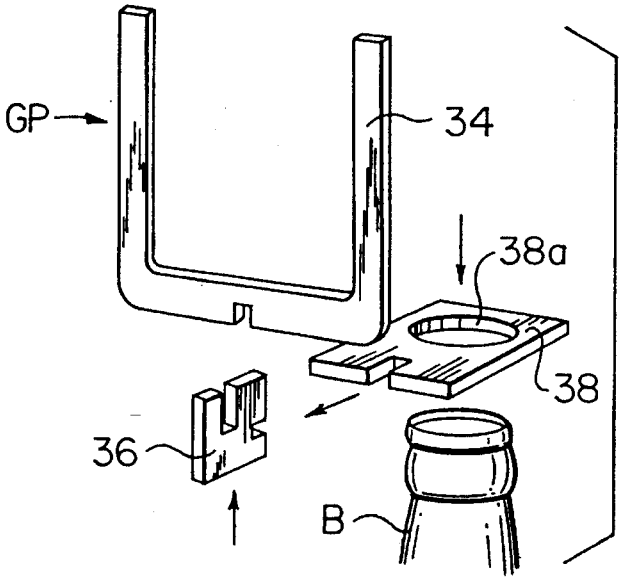
FIG. 8 is a perspective view showing the manner of assembly of yet another of the components of the game of FIG. 5.

Referring to FIG. 8, there is illustrated the manner in which the goal post assembly, denoted GP, is assembled. As shown, aperture 38*a* in element 38 is fitted over the neck of a beverage bottle B and is attached to support element 36 by engaging notch 38*a* in notch 36*b*; Notch 36*a* of element 36 is engaged in notch 34*a* in U-shaped element 34 which forms the "goal post."

Figure 9:
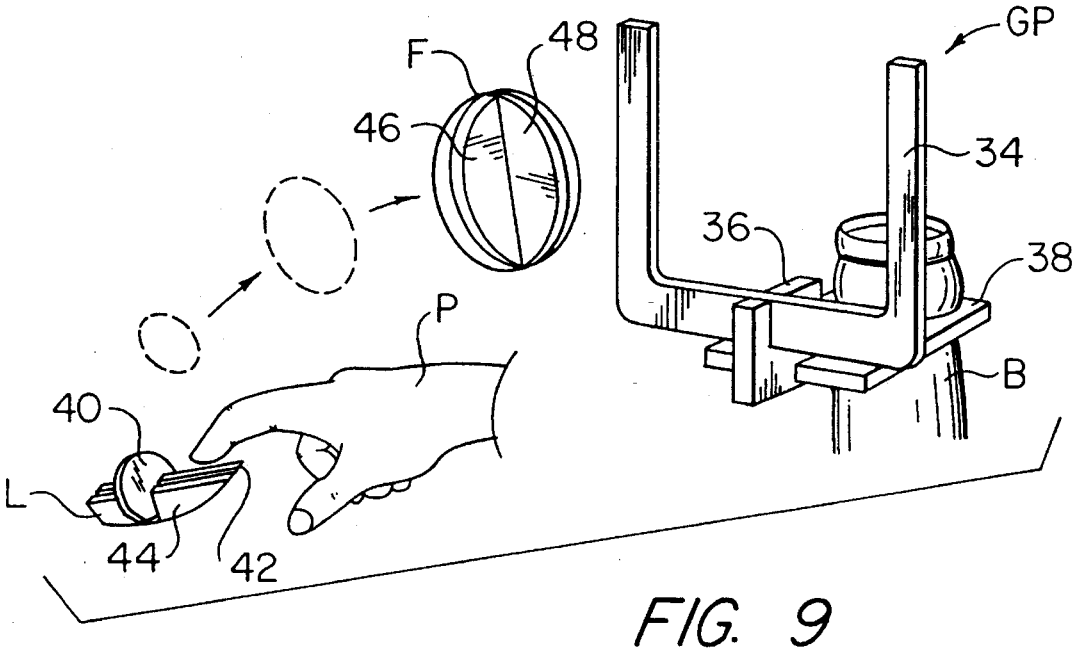
FIG. 9 is a perspective view of the manner in which the game of FIG. 5 is played.

As shown in FIG. 9, this game is played by mounting "football" F on one end of the launcher L and then having a player P rapidly reflect or pivot the launcher L so that the football F is propelled through the goal post GP.

Figure 10:
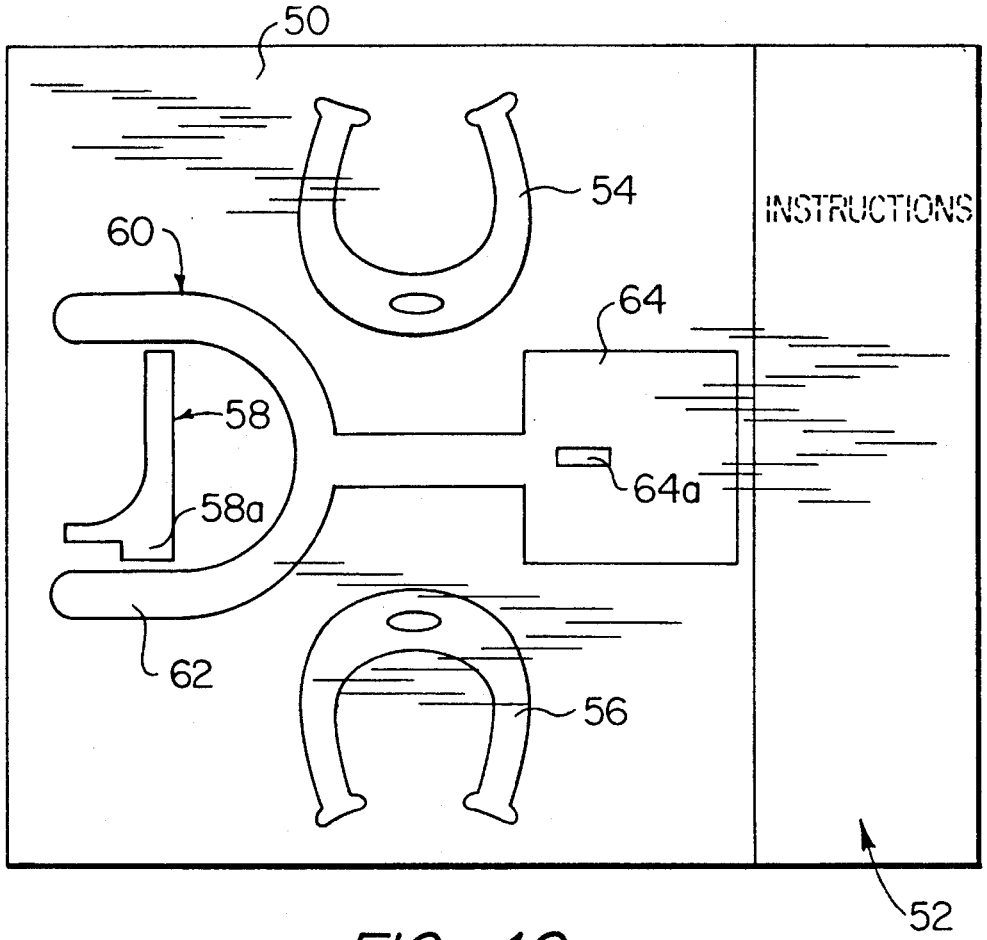
FIG. 10 is a plan view of a novelty punch-out game in accordance with a further embodiment of the invention.
Figure 11:
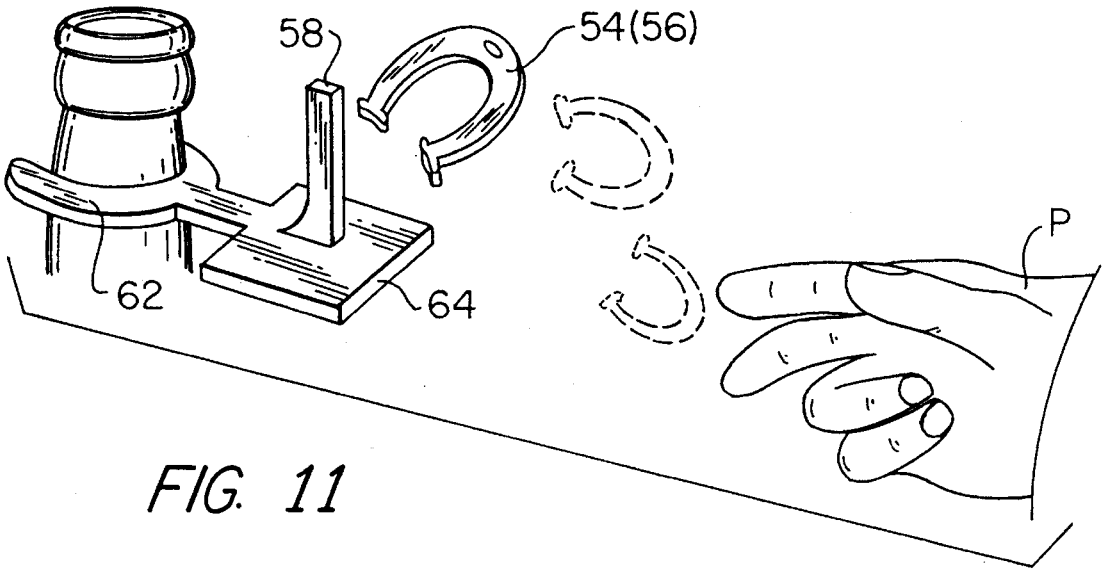
FIG. 11 is a perspective view of the manner in which the game of FIG. 10 is played.

Referring to FIG. 10 and 11, a further embodiment of the invention is shown. In this embodiment, a punch-out card 50 includes punch-out components which, when assembled, simulate the elements of the game of horseshoes. The card 50 also includes instructions, generally denoted 52, along one edge thereof.

The punch-out elements of the novelty game card of FIG. 10 include a pair of U-shaped "horseshoes" 54 and 56, an L-shaped element 58 which simulates a horseshoe stake and mounting member 60 including a U-shaped portion 62 and a rectangular base 64. Element 58 includes a lower projection or tab 58*a* which is received in a slot 64*a* in base 64.

As shown in FIG. 11, with projection 58*a* of the "stake" element 58 mounted in slot 64*a* and the U-shaped portion 62 secured around a beverage bottle B, the "stake" 58 is disposed in an upright position and serves as a target for player P who pitches the "horseshoes" 54 and 56 in an attempt to make a "ringer" around stake element 58.

Figure 12:
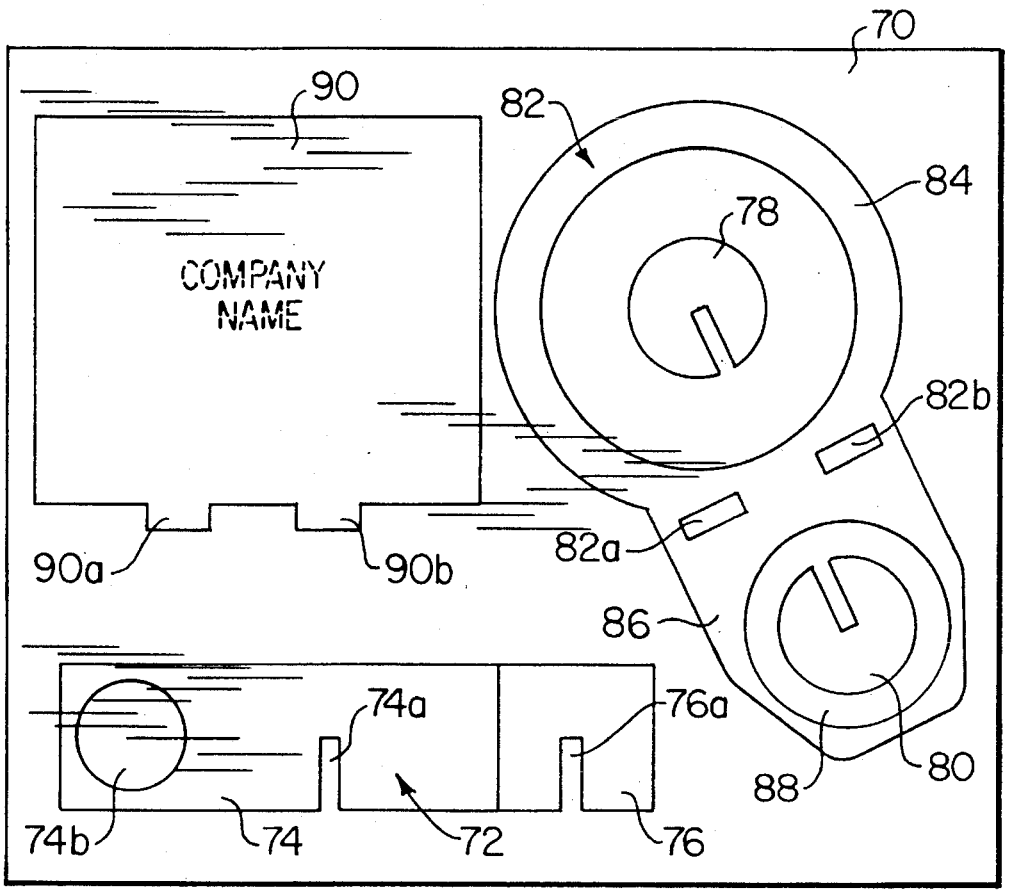
FIG. 12 is a plan view of a novelty punch-out card in accordance with the first embodiment of the invention depicted in FIGS. 1–4 and further including a backboard.

It will be appreciated that variations can be effected in the embodiments described above and, in this regard, a further embodiment of the "basketball" game of FIGS. 1 to 4 is shown in FIG. 12. This embodiment is similar to that of FIGS. 1 to 4, and the launcher component 72 is formed in the same way by elements 74 and 76 including interfitting slots 74*a* and 76*a* and a hole or aperture 74*b*. The "basket" element 82 is also similar and includes a hoop portion 84 and base portion 86 having a hole 88 therein but also includes slots 82*a* and 82*b*. These slots 82*a* and 82*b* receive the support tabs 90*a* and 90*b* of a "backboard element" 90 which forms a backboard for hoop or basket 84. In this embodiment, the "basketball" is formed from two slotted elements 78 and 80 in a manner similar to the "football" of FIGS. 5 to 9.

Figure 13:
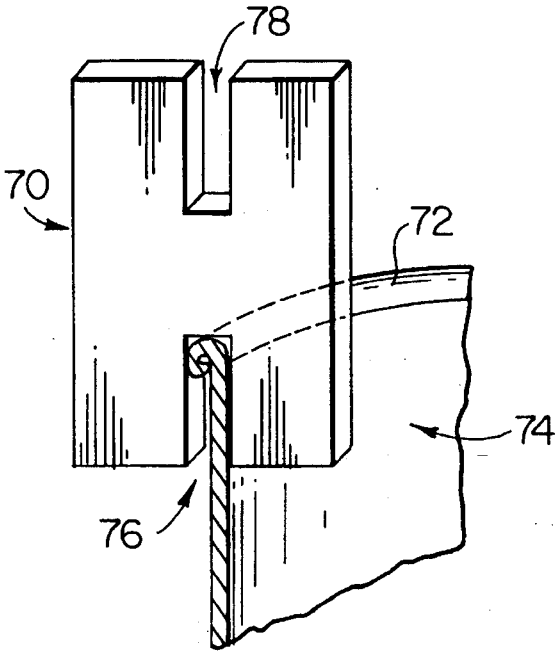
FIG. 13 is a cut away perspective view of an alternative affixing means according to the present invention for attachment to a cup.

Referring to FIG. 13, a mounting element 70 is depicted which can be used in place of mounting elements 36 and 38 depicted in FIG. 8. Mounting element 70 is used to mount U-shaped element 34 on an upstanding rim portion or wall of a cup, container, or other item. In this embodiment, mounting element 70 is mounted on a rolled rim 72 and the adjacent part of the wall of a plastic or paper cup 74 (only a side portion of which is shown), though an expanded rim is not necessary and any upstanding wall of proper size will serve to mount mounting element 70 in place.

Mounting element 70 includes a first slot 76 in one side thereof. First slot 76 receives the upstanding rim portion of cup 74 therein to mount mounting element 70 in place. Mounting element 70 also includes a second slot 78 on a side opposite from first slot 76. Second slot 78 is sized to mate with the slot provided at the base of U-shaped element 34 to mount U-shaped element 34 thereto in an upright position suitable to serve as a goalpost.

Figure 14:
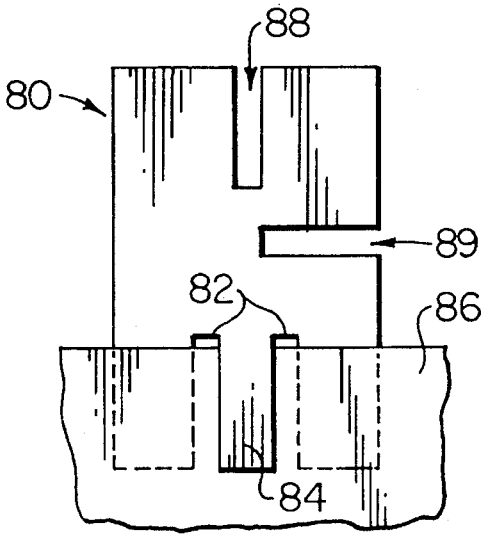
FIG. 14 is a schematic representation of another alternative embodiment of an affixing means according to the present invention for attachment to a rim.

Referring to FIG. 14, an alternative embodiment of a mounting element 80 to mounting element 70 is depicted. In this embodiment, mounting element 80 includes two first slots 82 in one side so that a tongue 84 is provided therebetween. In order to mount mounting element 80 to a thin wall 86, tongue 84 is simply pushed to one side of wall 86 while the remainder of mounting element 80 is located on the other side of wall 86. Wall 86 is thus trapped and resiliently held between tongue 84 on one side and the remainder of mounting element 80 on the other side to provide a firm mounting of mounting element 80.

Mounting element 80 also includes a second slot 88 at the opposite side from first slots 82. With second slot 88, U-shaped element 34 is mounted in the same manner as with element 36. It will also be appreciated that mounting element 80 includes a third slot 89 on an intermediate side between slots 82 and 88. With third slot 89, an extending member with a mating slot, such as a basketball hoop, could be mounted extending horizontally away and out of the plane of FIG. 14.

It will also be appreciated that both mounting elements 70 and 80 could be mounted in other orientations, such as horizontally (relative to the vertical orientations depicted). Mounting element 80 could even be mounted upside down (extending downwardly) if the resilience of tongue 84 and the remainder of mounting element 80 were sufficient to hold mounting element 80 and any attachment thereto in position.

For further versatility in mounting of the game apparatus, mounting element 70 (like mounting element 80) could be provided with two perpendicular slots to receive a target element which would similarly be provided with two perpendicular slots. With such a mounting element and target element, the target element could be mounted in the desired orientation using the appropriate slot to mate with the appropriate slot depending on whether the mounting element is mounted to either a vertical or horizontal wall. It will further be appreciated that mounting elements 70 or 80 could also form a portion integral with the target element in the manner depicted in FIG. 1 (i.e., with the U-shaped element projecting upwardly from the portion depicted as mounted to cup 74 or wall 86).

It will also be understood that other games can be simulated which employ a target or goal of some kind and a projectile or the like which is propelled by the player towards the target including, for example, soccer (net and ball), ice hockey (net and puck), field hockey (net and ball), lacrosse (net and ball) and so on. Moreover, other types of launchers for the "projectiles" and mounts for the "targets" can also be used and the launchers discussed above can be used with different games. Different ways of mounting the "targets" on the ubiquitous items can be used, and mounting devices can also be used to mount the "targets" on ubiquitous items such as cylindrical cans and other containers of other shapes, a drink cup, a holder, or any suitable fixture, as would be readily appreciated by those of ordinary skill in the art.

Thus, although the present invention has been described relative to specific exemplary embodiments thereof, it will be understood by those skilled in the art that other variations and modifications can be effected in these exemplary embodiments without departing from the scope and spirit of the invention.

What is claimed is:

1. A novelty punch-out game card comprising punch-out elements for, when assembled, simulating elements of a sporting game, said punch-out card comprising a card member including a plurality of elements adapted to be punched out of the card member, said elements including a mountable element including affixing means for, in use after said mountable element is punched out of said card member, affixing the mountable element to a support item; a target element integral with or affixable to said mountable element so as to, in use, form a target after being punched out of said card member; and at least one projectile element for, in use after being punched out of said card member, forming a projectile adapted to be propelled at said target.

2. A game card as claimed in claim 1 wherein said card member further comprises at least one further element adapted to be punched out from said card member and forming propelling means for propelling said projectile at said target.

3. A game card as claimed in claim 2 wherein said propelling means comprises at least two further elements adapted to be punched out from said card member.

4. A game card as claimed in claim 1, wherein said mountable element comprises base piece including a portion forming said affixing means and a portion simulating the rim of a basket used in basketball and wherein said target element comprises a further piece connectable to said base piece and simulating a backboard of a basket used in basketball.

5. A game card as claimed in claim 4 wherein said affixing means comprises an opening in said base piece adapted to fit around a neck of a bottle.

6. A game card as claimed in claim 1 wherein said mountable element includes a base piece including said affixing means, and said target element includes a substantially U-shaped piece connectable to said base member and simulating a football goal post.

7. A game card as claimed in claim 6 wherein said card member including an additional element adapted to be punched out of said card for interconnecting said base piece and said U-shaped piece.

8. A game card as claimed in claim 6 wherein said affixing means comprises an opening in said base piece adapted to fit around a neck of a bottle.

9. A game card as claimed in claim 6 wherein said at least one projectile element comprises first and second substantially identical ellipsoidal shaped pieces including means for connecting said ellipsoidal pieces together in orthogonal relation to simulate a football.

10. A game card as claimed in claim 1 wherein said mountable element includes a base piece including said affixing means, and said target member includes a stake piece affixed to said base piece and simulating a stake used in the game of horseshoes, said at least one said projectile element comprising a pair of substantially U-shaped pieces simulating horseshoes.

11. A game card as claimed in claim 10 wherein said affixing means of said base piece includes a substantially U-shaped portion adapted to fit around a base of a container.

12. A game card as claimed in claim 1 wherein the support item comprises a bottle including a neck and said affixing means comprises an opening in said mountable element adapted to fit around the neck of the bottle.

13. A game card as claimed in claim 1 wherein said card member includes an additional element adapted to be punched out of said card for interconnecting said mounting element and said target element.

14. A game card as claimed in claim 1 wherein the support item comprises a container having a base and said affixing means includes a substantially U-shaped portion adapted to fit around the base of the container.

15. A game card as claimed in claim 1 wherein the support item comprises a wall and said affixing means includes a slot in which the wall of the support item is received.

16. A novelty punch-out game card comprising punch-out elements for, when assembled, simulating elements of a sporting game, said punch-out card comprising a planar card member including a mountable element adapted to be punched out of the card member and including affixing means for, in use after the mountable element is punched out of the card member, affixing the mountable element to a support item; a further, target element adapted to be punched out of the card member and to be affixed, when so punched out, to said mountable element so as to form a target after being punched out of said card member; and at least two cooperating projectile elements, adapted to be punched out of said card member, for in use when so punched out and assembled together, forming a single projectile adapted to be propelled at said target.

17. A game card as claimed in claim 16 wherein said card member further comprises at least one further element adapted to be punched out from said card member and forming propelling means for propelling said projectile at said target.

18. A novelty punch-out game card comprising punch-out elements for, when assembled, simulating elements of a sporting game, said punch-out card comprising a card member including a plurality of elements adapted to be punched out of the card member, said elements including a mountable element including affixing means for affixing the mountable element to a suitable item; a target element integral with or affixable to said mountable element so as to form a target; and at least one projectile element, for, in use after being punched out of said card member, forming a projectile adapted to be propelled at said target; said card member further comprises at least two further elements adapted to be punched out from said card member and together forming propelling means for propelling said projectile at said target; said two further elements including cooperating connecting means for affixing said two further elements together in orthogonal relation to one another to form a pivotable launching assembly for said projectile.

19. A game card as claimed in claim 18 wherein there are two said further elements, and one of said two further elements is shorter than the other of said two further elements and forms a pivot axis around which said other further element can be pivoted.

20. A game card as claimed in claim 18 wherein there are three of said further elements, two of said three further elements comprising identical pieces which are separated along a common separation line and which each include a curved edge opposite the common separation line, said pieces, when punched out and separated, being securable together in parallel relation to form a rockable base which rocks on said curved edges, the other of said three further elements comprising a transverse connecting piece including means for securing said two further elements together in said parallel relation.

21. A novelty punch-out game card comprising punch-out elements for, when assembled, simulating elements of a sporting game, said punch-out card comprising a card member including a plurality of elements adapted to be punched out of the card member, said elements including a mountable element including affixing means for affixing the mountable element to a support item; a target element integral with or affixable to said mountable element so as to form a target; and a pair of projectile elements for, in use after being punched out of said card member, forming a projectile adapted to be propelled at said target, said mountable element comprising a base piece including a portion forming said affixing means and a portion simulating the rim of a basket used in basketball, said target element comprising a further piece connectable to said base piece and simulating a backboard of a basket used in basketball, and said projectile elements comprising a pair of circular pieces including means for connecting the circular pieces together in orthogonal relation to simulate a basketball.

* * * * *